US006240598B1

(12) United States Patent
Moore

(10) Patent No.: US 6,240,598 B1
(45) Date of Patent: Jun. 5, 2001

(54) ARRANGEMENT FOR CONTROLLING AN ANGULARLY MOVABLE MEMBER

(75) Inventor: David Moore, Elmesthorpe (GB)

(73) Assignee: Architectural Hardware Group Limited, Birmingham (GB)

( * ) Notice: Subject to any disclaimer, the term of this patent is extended or adjusted under 35 U.S.C. 154(b) by 0 days.

(21) Appl. No.: 09/446,368

(22) PCT Filed: Jun. 17, 1998

(86) PCT No.: PCT/GB98/01776

§ 371 Date: Dec. 20, 1999

§ 102(e) Date: Dec. 20, 1999

(87) PCT Pub. No.: WO99/00574

PCT Pub. Date: Jan. 7, 1999

(30) Foreign Application Priority Data

Jun. 25, 1997 (GB) ..... 9713348

(51) Int. Cl.[7] ..... E05F 3/04; E05F 3/14; E05F 3/22

(52) U.S. Cl. ..... 16/61; 16/51; 16/63; 16/65; 16/76; 16/77

(58) Field of Search ..... 16/61, 63, 65, 16/76, 77

(56) References Cited

U.S. PATENT DOCUMENTS

| | | | | |
|---|---|---|---|---|
| 528,321 | * | 10/1894 | Blount | 16/65 |
| 1,807,607 | * | 6/1931 | Smith | 16/65 |
| 1,965,805 | * | 7/1934 | Riggins | 16/65 |
| 2,544,372 | * | 3/1951 | Werner | 16/65 |
| 2,639,459 | * | 5/1953 | Werner | 16/65 |
| 2,705,631 | * | 4/1955 | Reichold | 16/65 X |
| 3,387,320 | * | 6/1968 | Waldo | 16/65 |
| 5,752,293 | * | 5/1998 | Lowry et al. | 16/342 |

* cited by examiner

*Primary Examiner*—Lynne H. Browne
*Assistant Examiner*—Ernesto Garcia
(74) *Attorney, Agent, or Firm*—Michael H. Minns

(57) ABSTRACT

A control mechanism for use with a door closer, comprises a shaft (10), angularly movable between a normal position and a second position, the shaft (10) having a first portion (21*a*) and a second portion (21*b*), a brush spring (35) attached to the shaft first portion (21*a*) to return the shaft to its normal position, and a damping mechanism (36, 38) attached to the shaft second portion (21*b*) to resist shaft movement to its normal position. The damping mechanism includes a coiled strap-like member (36) keyed to the shaft and contained in a damping medium.

9 Claims, 3 Drawing Sheets

ARRANGEMENT FOR CONTROLLING AN ANGULARLY MOVABLE MEMBER

This invention relates to an arrangement for controlling the movement of an angularly movement member, and has particular application to devices for controlling the movement of a wing, such as a door. Such devices include upright door closers, spring hinges and floor springs.

With known door closers the checking or regulation of the closing of the door is effected by the flow of hydraulic fluid, normally oil, from one side of a piston to the other. This involves the provision of machined fluid flow passages, and the normal sealing and pressures constraints associated with the use of hydraulic fluid.

An object of the invention is to provide an improved arrangement for controlling the movement of an angularly movable member.

According to the invention there is provided a control mechanism comprising:

a shaft being angularly movable between a normal position and a second position, the shaft having a first portion and a second portion;

a biasing means attached to the shaft first portion for returning the shaft to the normal position from the second position; and a damping mechanism attached to the shaft second portion, the damping mechanism resisting movement of the shaft when the shaft moves from the second position to the normal position.

Preferably said damping mechanism provides little or no resistance to movement of the shaft from the normal position to the second position.

Desirably the damping mechanism includes a non-pressurised damping medium, acting between the shaft and a further member. The damping mechanism can be a cage positioned about the strap-like member.

Conveniently the damping mechanism includes a coiled strap-like member. More preferably, the strap-like member is keyed to the shaft.

Advantageously the damping mechanism is a viscous coupling comprising a fluid chamber containing a non-pressurised damping medium, in which chamber is disposed a coiled strap-like member, keyed to one of the shaft or a housing part surrounding the shaft, wherein the strap-like member is wound about and off the housing part upon angular movement of the shaft in opposite directions respectively, the winding of the strap-like member about the housing part slowing the angular movement of the shaft taking place under the action of the biasing means.

Figure 1:
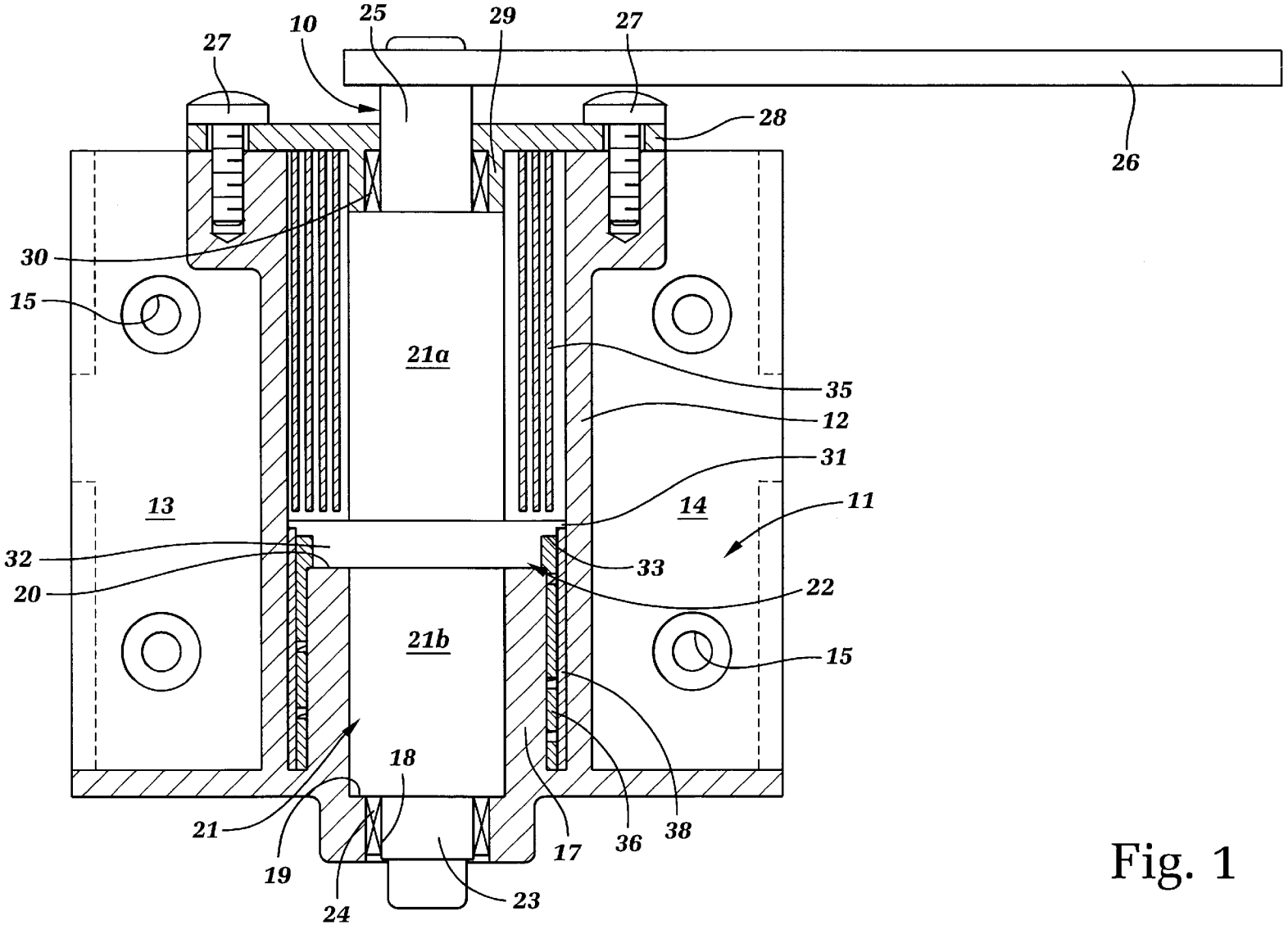
Figure 2:
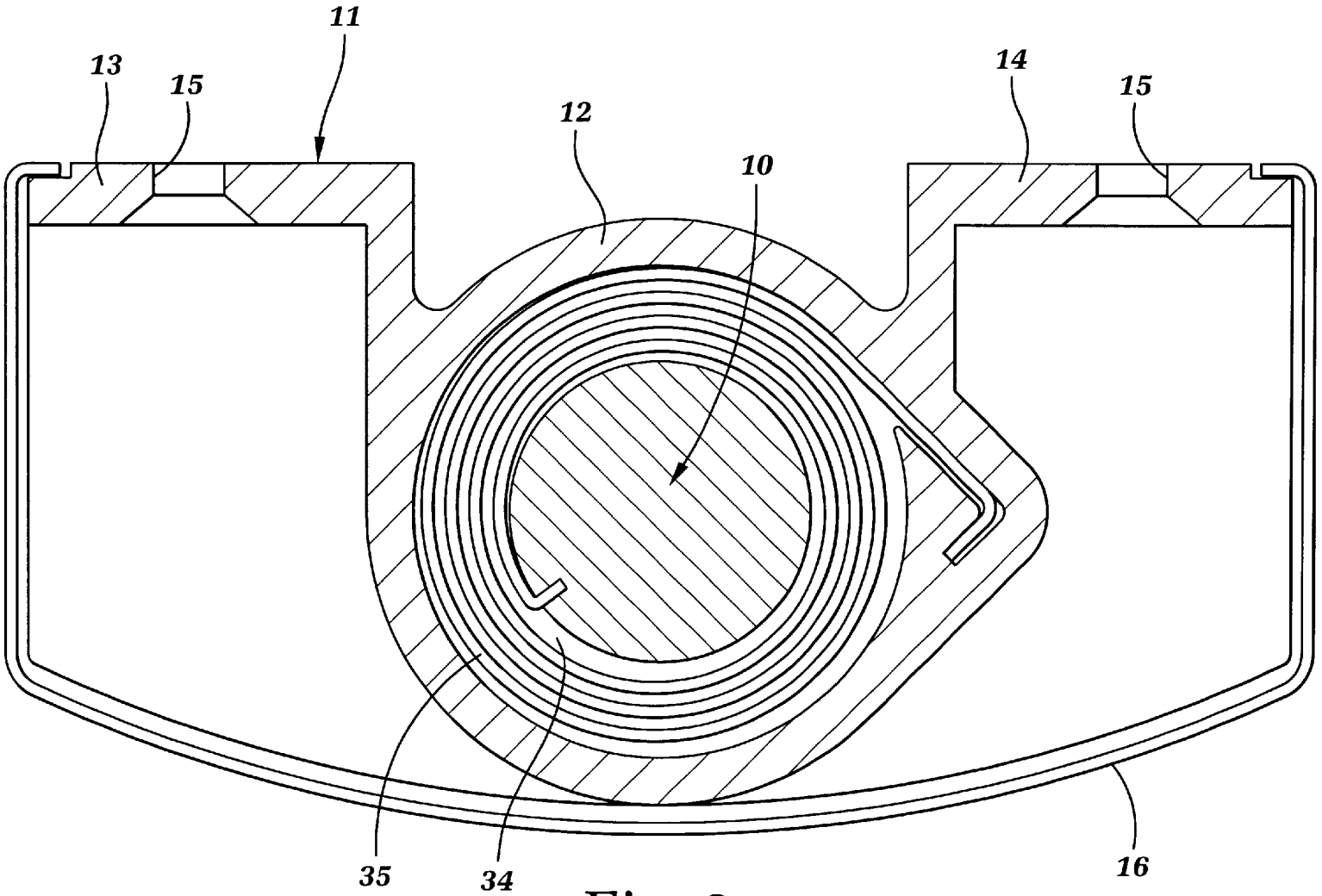
Figure 3:
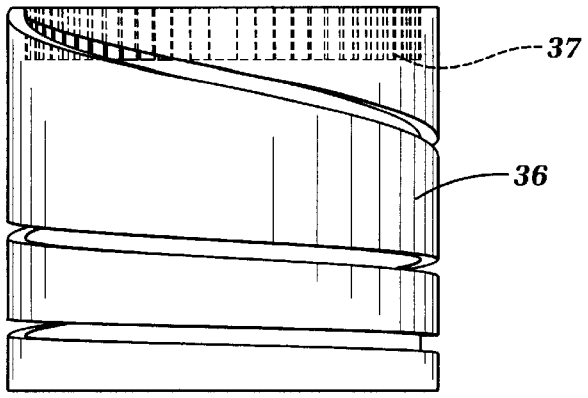
Figure 4:
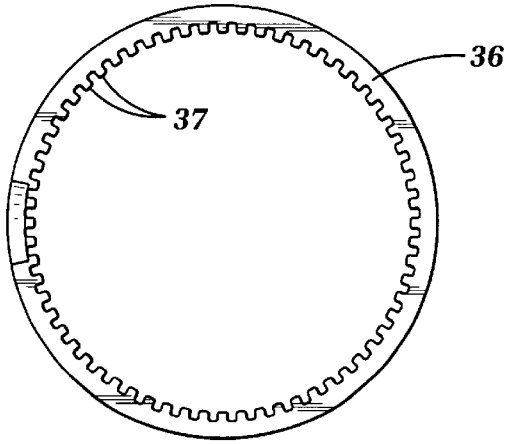
Figure 5:
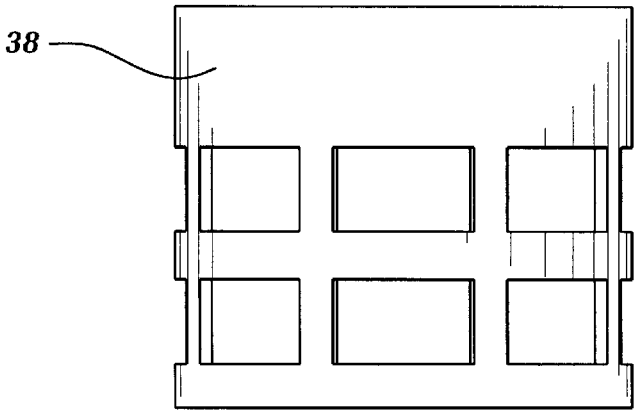

The invention will now be described, by way of example, with reference to the accompanying drawings, in which:

FIG. 1 is a partly interior, front view of a door closer incorporating the present invention, FIG. 2 is a horizontal section through the door closer of FIG. 1, FIGS. 3 and 4 are a side view and an end view respectively of one part of damping means of the invention, and FIG. 5 is a side view of another part of said damping means.

Although the present invention relates generally to an arrangement for controlling the movement of an angularly movable member, it has particular application to devices for controlling the movement of a pivoted wing, such as a door. The invention thus has particular application to devices such as door closers, spring hinges and floor springs, and the drawings show an embodiment of the invention where the arrangement for controlling the movement of an angularly movable member is incorporated into a door closer for operational attachment between a door and associated frame in the normal manner to control opening and closing movements of the door.

The door closer shown in the drawings is of the upright type having a vertical operating spindle 10 mounted in a housing 11 of the closer for angular movement about its central vertical axis, in use. The housing 11 is formed with a central cylindrical, generally tubular body 12 from which at the rear thereof a pair of rectangular fixing plates 13, 14 respectively extend laterally in opposite directions, these plates being provided with holes 15 for fixing screws, not shown, for securing the housing to a door. As shown in FIG. 2, a cover 16 can be provided, extending from one plate to the other around the front of the body so as to conceal it from view in normal use.

At the bottom of the body, there is formed an internal cylindrical upstanding boss 17 which is internally stepped inwards adjacent its lowermost end which is formed with a cylindrical opening 18, the step forming a shoulder 19. The boss could be separate from the body 12 instead of being formed integrally with it. The upper end of the boss defines an upwardly facing flat annular surface 20.

Rotationally fitted in the body 12 is said operating spindle 10, this being formed in one piece and having various steps and annular projections along its length. Except at its ends, however, the spindle is of circular cross-section.

The main part of the spindle 10 is formed with a cylindrical portion 21 which is divided into equal diameter upper and lower parts 21*a*, 21*b* respectively by a radial collar 22 which extends outwardly from the outer periphery of the portion 21, as shown in FIG. 1. The lower part 21*b* is a close but angularly movable fit in the larger diameter interior portion of the boss 17, the end of the part 21*b* engaging against or being in juxtaposition with the shoulder 19 of the boss 17. Projecting from the bottom of this lower part 21*b* is a stub shaft 23, this extending through the opening 18 and being surrounded therein by a bearing 24 for angular movement of the spindle 10 as will be described. The end of the shaft 23 is formed with a square end termination for drive coupling.

The upper part 21*a* of the spindle 10 extends upwardly through the interior of the cylindrical tubular body 12 with a fair amount of clearance from the interior surface thereof. At its upper end, the part 21*a* is formed with a smaller diameter shaft 25 which projects out of the body and has a square end termination for the fixed connection thereto of a door closer operating arm 26. The arm 26 can be of any conventional form, for example a slide arm carrying a slider which travels within a track, or part of a scissors-type mechanism.

As shown in FIG. 1, the top of the body has diametrically opposed lateral extensions for receiving screws 27 for fixing a top cover 28 to the housing. The cover is of generally plate-like form so as to close the top of the body, but has a downwardly depending annular projection 29 which has the same outer diameter as the parts 21*a* and 21*b* of the spindle 10. The bottom of this projection 29 engages the shoulder of the spindle between the upper part 21*a* and the shaft 25, and within the projection 29, around the shaft 26 is a bearing 30. The shaft 25 extends through a circular opening in the centre of the cover 28 as shown in FIG. 1, and appropriate seals would be provided if necessary between any of the components described.

As shown in FIG. 1, the collar 22is stepped, having a full diameter part 31 adjacent the upper part 21*a* of the spindle 10 and a reduced diameter part 32 adjacent the lower part 21*b*, the step between the two parts 31, 32 defining a downwardly facing annular shoulder surface 33. The lower surface of part 32 is disposed just above surface 20. As can be seen in FIG. 1, the longitudinal extent of the part 32 is significantly greater than that of the part 31. The outer periphery of the part 31 is a close fit of the internal wall of the body 12, and appropriate sealing would be provided so that this part 31 effectively separates the interior of the body into two separate compartments, namely an upper compartment 34 containing the upper part 21*a* of the spindle 10, and a lower compartment around the outside of the boss 17 and around the outer periphery of the part 32.

Disposed in the upper compartment 34 is a coiled brush spring 35, it being shown in FIG. 2 how the two ends of this spring are anchored to the shaft 10 and body 12 respectively. The inner end of the spring is bent through 90° into a recess in the periphery of the upper part 21 a of the spindle, whilst the outer end of the spring is similarly bent through 90° and received into a correspondingly shaped recess in a laterally outwards thickening of the body. It can be seen that the spring is coiled around the upper part 21*a* of the spindle with the outermost coil being against or substantially against the interior surface of the upper compartment 34 in its normally (relaxed) tensioned state when the door is closed.

This form of closer with an upper restoring spring is well known, and is for example shown in British Patent No. 217146 and U.S. Pat. No. 528,321. However with this form of prior art closer the casing or body was generally in the form of an inverted T with the lower part of the casing acting as an hydraulic chamber for the linear movement of a piston connected to the operating spindle by means of the crank at the end thereof. Various hydraulic fluid flow passages together with appropriate hydraulic sealing means were required in this lower passage in order to control or damp the angular movement of the door closer spindle, in use, particularly when the door is being closed by virtue of the spring of the closer equivalent to the brush spring 35 of the present application. However as mentioned in the introduction hereto, this type of arrangement involves the provision of machined fluid flow passages together with the normal constraints of sealing and of pressurisation associated with the use of hydraulic fluid. In the illustrated embodiment of the present invention, the upright spindle-type closer overcomes these disadvantages by damping the angular movement of the spindle by means of a non-pressurised damping arrangement in the form of a viscous coupling in the lower compartment, this coupling being between the angularly movable spindle and the relatively fixed body in the form of the boss 17.

In the lower compartment is disposed a coupling member in the form of a wrap, such as a coiled friction belt such as a nylon cord or strap 36. As shown in FIGS. 3 and 4, the coiled strap is in the form of a hollow cylinder with the turns of the coil generally increasing in their longitudinal extent, measured axially of the strap, from the end of the strap which is lowermost in use, as shown in FIG. 1, up towards its uppermost end where after reaching its greatest longitudinal extent, the coil runs out. As shown in FIG. 4, the internal surface at the upper end of the strap is formed with serrations 37 for keying the strap to the spindle 10 as will be described.

As shown in FIG. 1, the axial length of the coiled strap 36 is substantially equal to the vertical height of the lower compartment and the internal diameter of the strap in its normal coiled state is such that its internal surface below the serrations interacts with the outer surface of the boss 17, the coils of the strap being inherently biased to return to this state when unwound, as will be described.

The strap 36 is thus disposed in the lower compartment as shown in FIG. 1, with the serrations 37 engaged with corresponding keying mean not shown around the outer periphery of the p art 32 of the collar 22, with the upper annular end surface of the strap engaging against the shoulder surface 33 of the collar. In this way the strap is connected to the spindle 10 so that its winding and unwinding, as will be described, are related to the angular movement of the operating spindle.

Around the outside of the strap 36 substantially mid-way between the outer surface of the strap and the inner surface of the body is a hollow cylindrical cage 38 which, over the lower part of its surface area, is provided with grid-like openings. The cage is free to move angularly, under normal circumstances, as shown in FIG. 1, in the lower compartment, which is sealed from the upper compartment and filled with fluid, such as oil or grease. From FIG. 1 it can be seen that the axial length of the cage is such that it extends substantially fully from the shoulder 33 of the collar 22 to the bottom of the lower compartment.

The cage 38 serves, as will be described, to prevent 'earthing' of the strap 36 against the body 12, and also to some extent retains the oil or other fluid around said strap. The arrangement of the strap keyed to the spindle, and being contained in the fluid filled compartment provides a viscous coupling so that, as will be described, closing movement of the door to which the door closer is fitted, under the restoring action of the brush spring 35, will be damped.

FIG. 1 shows the respective states of the various components when the door to which the closer is fitted is in its closed position. In this state the strap 36 is in its normally coiled state in which it is 'wrapped' around the outer surface of the boss 17, with there being a very thin film of oil or other suitable fluid between the boss outer surface and the inner surface of the strap. As the door is opened, the arm 26 will move anticlockwise, as viewed in FIG. 2, so as to tension the brush spring 35 by more tightly coiling it. As the angular movement of the arm, and thus also of the spindle 10, takes place, the strap 36, (a right hand helix), which is keyed to the spindle by way of the collar 22, tends to uncoil so that it eventually engages against the interior surface of the cage 38 which then angularly moves therewith in the oil in the lower compartment of the body. This provides a friction free condition in the lower chamber so that the opening of the door is resisted wholly or substantially wholly by the restoring force of the brush spring 35.

Once the opening force on the door is removed, the brush spring 35 will, as is well known, begin to uncoil so as to move the spindle in a clockwise direction, as viewed in FIG. 2, so as to move the arm 26 to close the door automatically. However with the viscous coupling described and illustrated, this restoring movement imparted by the brush spring to the spindle 10 is resisted and thus damped by said viscous coupling. As the spindle begins to move angularly in the clockwise direction, as described, a viscous drag is imparted to the band as it attempts to return to its 'coiled' state shown in FIG. 1. The drag increases as the recoiling of the strap continues, this drag being amplified towards the upper coils of the strap in its FIG. 1 orientation. Accordingly the angular return movement of the spindle 10 under the influence of the brush spring 35 is damped until the FIG. 1 position is again reached where the spindle 10 is in its rest position with the door closed. In this state the strap has again reached its 'coiled' rest position.

Mathematically the action of this viscous coupling can be explained by referring to a tension $T_2$ at the lower free end of the strap, and a greater tension $T_1$ at the upper end of the strap where it is fixed to the shaft. The tension $T_1$, for example in Newtons, is a function of the angle of wrap, and the friction caused by the oil or grease. $T_2$ is the result of the free end of the strap interfacing with the viscous film that effects $T_1$. The damping effect or friction is caused between the moving wrap at $T_2$ and the viscous film around the sator, namely the boss 17. This is then factored up by the angle of wrap to the greater tension at $T_1$. The viscous drag at the position of $T_2$ will tend to open the strap on anticlockwise movement of the shaft.

If $\mu$ is the coefficient of friction of the fluid in the damping chamber and θ the angle of 'wrap', in radians, of the strap, then $$\log e \frac{T_2}{T_1} = \mu\theta$$

and thus by the use of this formula it is possible to calculate the respective values of the variables which are required to produce the required damping.

Although from the consideration of the strength of the strap, it is desirable for its axial width to increase inwards from its free end, as shown in FIG. 3, this is not essential, in that an equivalent strap with constant width turns could be employed. The use of this viscous coupling, which thus provides non-pressurised damping of the spindle movement, overcomes the disadvantage of the prior art closers referred to. In the present case it is merely necessary to provide a seal between the upper and lower compartments in the body, and between the spindle and boss, in order to retain the oil in the lower compartment and it will be appreciated that there are no passageways required for flow of oil therethrough. Moreover there is no pressurisation of the oil or other suitable damping fluid as with the conventional closer referred to.

It is envisaged that the coupling could be adapted to provide some form of regulation to allow for the door closing speed to be altered and additionally it may be possible to provide means which produce a latching force adjacent the end of the closing movement automatically to force the door shut. In an alternative embodiment, the wrap could be arranged to be bidirectional, providing back-check as well as forward-check for the door closer.

As previously mentioned, the invention, for example in the form described and illustrated, is also believed to be applicable to spring hinges and to floor springs, in both of which cases the angular movement of a pivot/shaft would be controlled by non-pressurised damping means.

What is claimed is:

1. A control mechanism, for use with a door closer comprising:

a shaft being angularly movable between a normal position and a second position, the shaft having a first portion and a second portion;

a biasing means attached to the shaft first portion for returning the shaft to the normal position from the second position; and a damping mechanism attached to the shaft second portion, the damping mechanism resisting movement of the shaft when the shaft moves from the second position to the normal position, the damping mechanism including a fluid chamber containing a non-pressurized damping medium and a coiled strap member disposed within the fluid chamber, the coiled strap member having multiple turns wrapped around the shaft second portion and having one end free.

2. The control mechanism according to claim 1, wherein the damping mechanism provides little or no resistance to movement of the shaft from the normal position to the second position.

3. The control mechanism according to claim 1, wherein the strap-like member is keyed to the shaft.

4. The control mechanism according to claim 1, wherein the second portion of the shaft fits within a stationary housing member and the strap-like member fits around a boss of the stationary housing member.

5. The control mechanism according to claim 1, wherein the damping mechanism further includes a cage member positioned around the outside of the strap member.

6. The control mechanism according to claim 5, wherein the cage member is a hollow cylindrical cage with grid openings.

7. The control mechanism according to claim 1, wherein the strap member is in the form of a hollow cylinder having the turns of the coil generally increasing in width from one end of the coil towards its other end.

8. The control mechanism according to claim 1, wherein the coiled strap member is keyed to a collar of the shaft, and wherein the strap member is wound upon angular movement of the shaft to the normal position, and the winding of the strap member slows the angular movement of the shaft taking place by the biasing means.

9. The control mechanism according to claim 1, wherein the biasing means is a brush spring.

* * * * *